US005838289A

United States Patent [19]

Saito et al.

[11] Patent Number: 5,838,289

[45] Date of Patent: Nov. 17, 1998

[54] EL DISPLAY DRIVER AND SYSTEM USING FLOATING CHARGE TRANSFERS TO REDUCE POWER CONSUMPTION

[75] Inventors: Hideki Saito, Kariya; Minoru Yokota, Nagoya; Masahiko Osada, Hekinan, all of Japan

[73] Assignee: Nippondenso Co., Ltd., Kariya, Japan

[21] Appl. No.: 534,172

[22] Filed: Sep. 26, 1995

[30] Foreign Application Priority Data

Oct. 4, 1994 [JP] Japan ..... 6-240384

[51] Int. Cl.[6] ..... G09G 3/30

[52] U.S. Cl. ..... 345/79; 345/76; 345/94; 345/212

[58] Field of Search ..... 345/76, 79, 80, 345/87, 94, 96, 100, 99, 209, 212, 78

[56] References Cited

U.S. PATENT DOCUMENTS 4,594,589 6/1986 Ohba et al. .
4,652,872 3/1987 Fujita ..... 345/78
4,864,182 9/1989 Fujioka e tal. .
4,888,523 12/1989 Shoji et al. ..... 345/209
5,528,256 6/1996 Erhart et al. ..... 345/96

FOREIGN PATENT DOCUMENTS 60-147790 8/1985 Japan .
4-355789 12/1992 Japan .

*Primary Examiner*—Richard A. Hjerpe
*Assistant Examiner*—Kent Chang
*Attorney, Agent, or Firm*—Pillsbury Madison & Sutro LLP

[57] ABSTRACT

An EL display driver is capable of reducing electric power consumption during driving of an EL display without a significant increase in device structure and control complexity. In a thin film EL display having scanning electrodes and data electrodes arranged orthogonally crossing one another holding an EL layer therebetween, by reversing the polarity of scanning voltages for every other field, then switching scanning electrodes (display lines) to which scanning voltages are applied, FETs for connecting a subsequent display line to a voltage supplying line are switched on where no scanning voltage is applied to a positive or negative voltage supplying line and part of an electric charge stored in an EL element for which display control is finished is directly moved to an EL element on a subsequent display line. As a result, electric power consumption for driving the EL display can be reduced.

14 Claims, 7 Drawing Sheets

| FIGS. 1A-1P |
| --- |
| FIGS. 1A-1J |
| FIGS. 1K-1P |

T1 FIRST FIELD
T2 SECOND FIELD
V10a
V10b
V10c
V20a
V20b
V20c
VP1
VN1
VP2
VN2
VP3
VN3
VPE
VNE

EL DISPLAY DRIVER AND SYSTEM USING FLOATING CHARGE TRANSFERS TO REDUCE POWER CONSUMPTION

CROSS-REFERENCE TO RELATED APPLICATIONS

This application is related to and claims priority from Japanese Patent Application No. Hei. 6-240384, incorporated herein by reference.

BACKGROUND OF THE INVENTION

1. Field of the Invention

The present invention relates to an EL display driver for driving an EL (electroluminescent) display which includes AC-driven type capacitive EL elements, and in particular to such a driving device suited for reducing electric power consumption when driving the EL display.

2. Description of the Related Art

Conventionally, in an EL display driver, discharging of electric charges from each EL element has been performed by simply grounding the electrode thereof. With this method, however, electricity charged to the EL element is discarded each time each line is displayed, thereby increasing the electric power consumed in driving the EL display.

In order to solve such a problem, Japanese Laid-Open Patent Publication No. Sho. 63-168998 proposes reducing electric power consumption when driving an EL display by temporarily storing part of the electric charge accumulated in an EL element in an external capacitor for accumulating electric charge and reutilizing the electric charge stored therein the next time light is to be emitted.

In a device based on this idea, however, it was necessary to provide a capacitor for storing electric charge and a circuit for storing electric charge therein and discharging it therefrom and consequently the number of circuit elements and the area occupied by the circuit increased and control thereof became complicated.

Also, a device which requires no capacitors for storing electric charge was disclosed in Japanese Laid-Open Patent Publication No. Hei. 4-355789. In this device, a two-way switch is provided between an odd numbered electrode scanning side driver and an even numbered electrode scanning side driver, a scanning electrode to which a scanning voltage has been applied and one to which the scanning voltage is applied next are connected via this two-way switch and part of the electric charge stored in the EL element to which the scanning voltage has been applied is moved to the EL element to which the scanning voltage is next applied.

However, a special switch must be provided for electrode transfer in the above-described device. Thus, the number of circuit elements and the area occupied by the circuit are increased and control thereof is complicated.

SUMMARY OF THE INVENTION

The present invention was made in order to solve the problems described above and it is an object of the invention to provide an EL display driver capable of reducing electric power consumption when driving of the EL display without increasing the number of circuit elements or circuits and without complicating control thereof.

In a driving device of an EL display according to a first aspect of the invention, a scanning voltage impressing section applies scanning voltages to a plurality of scanning electrodes of the EL display successively with a prescribed scanning timing while a display voltage impressing section applies a display voltage corresponding to display data to the data electrode of the EL display synchronously with this scanning timing. Consequently, the display voltage, in other words, a voltage corresponding to the display data, charges an EL element formed at an intersection between the data electrode to which the display voltage is applied and the scanning electrode to which the scanning voltage is applied and thereby light emission and nonemission are controlled in accordance with the voltage value thereof.

The scanning voltage applied to the scanning electrode by the scanning voltage impressing section is reversed by a scanning voltage reversing section to a positive or a negative voltage every other field where the scanning voltage impressing section completes application of the scanning voltages to all the scanning electrodes. As a result of this, the polarity of the voltage applied to each EL element is reversed to a positive or a negative voltage every other field. More specifically, the driving device functions as a driving device of so-called reversal driving type which drives the EL display by reversing the driving voltage to a positive or a negative voltage.

In the present invention, while it applies the scanning voltage to a subsequent scanning electrode after it finishes applying the scanning voltage to a scanning electrode, an electric charge moving section provided in the scanning voltage impressing section connects the scanning electrode to which the scanning voltage has been applied to the scanning electrode to which the scanning voltage is subsequently applied and moves part of the electric charge stored in the EL element of the scanning electrode to which the scanning voltage has been applied to the EL element of the subsequent scanning electrode.

Thus, according to the present invention, part of the electric charge used for controlling the display of the previous scanning electrode already charges the subsequent scanning electrode at the time of applying the scanning voltage thereto, and therefore the amount of electric power consumed at the time of applying a voltage to each scanning electrode and hence the amount of electric power consumed for driving the EL display can be reduced.

Furthermore, in the present invention, the electric charge moving section is provided in the scanning voltage impressing section, and using this electric charge moving section, the scanning electrode to which the scanning voltage has been applied (in other words after display control is finished) is connected to the scanning electrode to which the scanning voltage is subsequently applied. In this way, part of the electric charge used for display control is moved to the subsequent scanning electrode.

Thus, it is not necessary to specially provide an electric charge storing capacitor for the transfer of the charge, and electric power consumption can be reduced with an extremely simple circuit structure. Moreover, it is not necessary to specially provide a circuit containing a capacitor on the display voltage impressing section side for applying the display voltage to the data electrode; thus, the circuit on the data electrode side and the control thereof can be prevented from being complicated.

In an EL display driving device according to a second aspect of the invention, instead of the scanning voltage reversing section for reversing the polarity of the scanning voltage applied to the scanning electrode to a positive or a negative voltage every other field, a refreshing voltage impressing section is provided, so that a refreshing voltage having a polarity different from the one at the time of image display is applied across the scanning electrode and the data electrode every other field. That is, the driving device provided by this aspect of the invention is constructed as one of a so-called refreshing driving type which applies a refreshing voltage across the scanning electrode and the data electrode every other field and thereby prevents polarization of the EL layer.

Also, in a driver according to the second aspect of the invention, while the scanning voltage impressing section applies the scanning voltage to the subsequent scanning electrode after finishing applying the scanning voltage to a scanning electrode, the electric charge moving section provided therein moves part of electric charge stored in the EL element of the scanning electrode to which the scanning voltage has been applied to the EL element of the subsequent scanning electrode. Therefore, in a driving device according to the second aspect of the invention, the same effect as in the case of the driving device according to the first aspect of the invention can be obtained.

In an EL display driver according to a third aspect of the invention, a scanning voltage impressing section includes a common path for supplying a scanning voltage to each scanning electrode, multiple switching elements provided between this common path and each scanning electrode, a driving section for successively turning on the plurality of switching elements in synchronously with a scanning timing and a voltage supplying section for periodically applying a scanning voltage to the common path synchronously with the scanning timing for successively turning on the switching elements, where the voltage supplying section applies a scanning voltage to the common path, the driving section turns on the switching elements provided between the common path to which the scanning voltage is applied and a scanning electrode to which a scanning voltage is to be applied, and thereby the scanning voltage is applied to the scanning electrode.

The electric charge moving section connects the scanning electrode to which the scanning voltage has been applied to a scanning electrode to which a scanning voltage is subsequently applied via the common path by turning on the switching elements with a floating timing where the voltage supplying section applies no scanning voltage to the common path. Consequently, electric charge stored in the scanning electrode to which the scanning voltage has been applied is directly moved to the subsequent scanning electrode via the common path.

Thus, in the driving device of the present invention, it is not necessary to specially provide an electric charge storing capacitor and circuit elements for electric charge transfer (in other words, for reducing electric power consumption) including switching elements for connecting electrodes, etc., in order to move electric charge from the scanning electrode to which the scanning voltage has been applied to the subsequent scanning electrode, and this allows utilization of driving circuits of conventional devices without any modifications.

In an EL display driver according to a fourth aspect of the invention, an electric charge moving section is provided with an electric charge storing capacitor having a capacity larger than that of one or all of a plurality of EL elements of at least each scanning electrode and a capacitor connecting switch for connecting this capacitor to a common path, and when the application of the scanning voltage to the last of scanning electrodes to which scanning voltages are applied within one field is finished, the electric charge storing capacitor is connected to the common path by turning on the capacitor connecting switch for a specified period of time and then, when a scanning voltage is applied to the first of the scanning electrodes to which scanning voltages are applied within one field, the capacitor connecting switch is turned on again for a specified period of time and thereby the electric charge storing capacitor is connected to the common path.

Thus, in a driving device of this fourth aspect of the invention, not only is part of the electric charge used for display control moved from the scanning electrode to which the scanning voltage has been applied to the scanning electrode to which the scanning voltage is subsequently applied, but also part of the electric charge stored in the EL element of the last scanning electrode is temporarily stored in a capacitor having a relatively large capacity for storing electric charge via the capacitor connecting switch, and then at the time of applying the scanning voltage to the first of the scanning electrodes part of the electric charge stored in the capacitor is moved to the EL element of the first scanning electrode.

As described above, in the devices according to the first to third aspects of the invention, electric power consumed at the time of driving the EL display is reduced by directly moving part of the electric charge stored in the EL element which has undergone display control end application of the scanning voltage thus far to the next EL elements which undergo display control and application of the scanning voltage at the time of switching the scanning electrodes to which the scanning voltage is applied. However, since in the EL display by reversal driving or refresh driving it is necessary to apply a voltage of reverse polarity to the EL element whenever the display control of one field is finished, it is not possible to move part of the electric charge stored in the last of the plurality of scanning electrodes to which the scanning voltages are applied to the first of the scanning electrodes to which the scanning voltages are applied in the subsequent field.

Given such a situation, the present invention makes it possible to reduce electric power consumption of the first scanning electrode to which the scanning voltage is applied in one field by temporarily storing part of the electric charge used for the display control of the EL element of the final scanning electrode and moving electric charge stored in the capacitor to the first scanning electrode at the next time of scanning the same polarity. As a result, according to the present invention, electric power consumption is further reduced.

Moreover, in this case, though it is necessary to provide an electric charge storing capacitor and a capacitor connecting switch, this capacitor connecting switch needs only to be turned on once at the beginning and end of one field and thus it is not necessary to perform charging and discharging of the capacitor whenever the scanning electrodes are switched as in the case of a conventional device having an electric charge storing capacitor on the data electrode side. For this reason, compared with a conventional device for reducing electric power consumption by using the capacitor, switching of the capacitor connecting switch can be performed by simple control and the number of charging/dischargings of the capacitor is extremely small, thereby improving the durability thereof.

Furthermore, in an EL display driver according to a fifth aspect of the invention, when application of scanning voltages and movement of electric charge are performed with one or multiple scanning electrodes by the scanning voltage impressing section and the electric charge moving section, a discharging section discharges electric charge remaining in the EL element of a scanning electrode to which the scanning voltage has been applied and from which the electric charge has been moved.

More specifically, as described above, in a case where the electric charge is directly moved from an EL element for which display control is finished to the subsequent EL element by connecting a scanning electrode to which a scanning voltage has been applied and one to which the scanning voltage is subsequently applied and electric charge stored in the EL element of the last scanning electrode is moved into a capacitor, a remaining electric charge which has not been moved (roughly half the electric charge at the time of display control) continues to be stored in the EL element after the movement of the electric charge, and this residual charge may cause the EL element to deteriorate.

Given this situation, according to the fifth aspect of the invention, the discharging section is provided to further discharge electric charge remaining in the EL element after the movement of the electric charge, thereby shortening the period of time for storing electric charge after driving each EL element. This prevents deterioration of the EL element due to remaining electric charge and further improves the durability of the EL display.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

Figure 2:
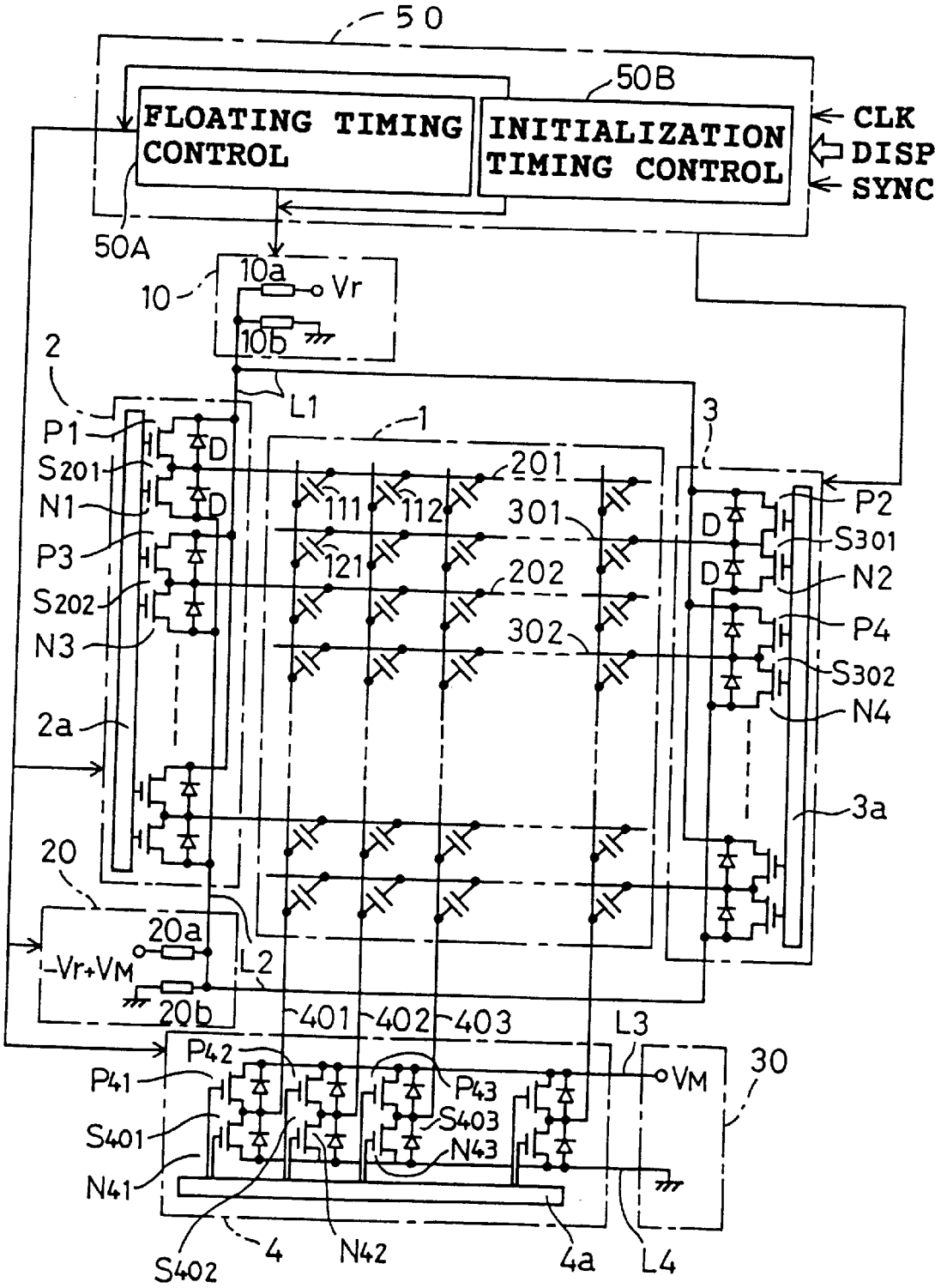
FIG. 2 is a schematic diagram showing the overall structure of an EL display driver according to the first embodiment.

As shown in FIG. 2, a thin film EL display (hereinafter simply called a display) 1 includes scanning electrodes 201, 202, etc. of odd numbered lines and scanning electrodes 301, 302, etc. of even numbered lines arranged alternatingly and in parallel to one another on one side of an EL layer and data electrodes 401, 402, etc. in a plurality of columns orthogonally crossing the scanning electrodes arranged in parallel with one another on the other side thereof, and EL elements 111, 112, etc. are formed as pixels where the scanning electrodes 201, 202, etc. and 301, 302, etc. cross the data electrodes 401, 402, etc. For example, the EL element 111 is formed where the scanning electrode 201 crosses the data electrode 401, the EL element 112 is formed where the scanning electrode 201 crosses the data electrode 402 and the EL element 121 is formed where the scanning electrode 301 crosses the data electrode 401.

The EL element is a capacitive element and thus is represented by the symbol of a capacitor in FIG. 2. For the same reason, it is necessary to alternately apply voltages to the scanning electrodes 201, 202, etc., 301, 302, etc. and the data electrodes 401, 402, etc. where EL elements are formed in order to emit light therefrom and to set the absolute values of voltages applied thereto equal to or higher than a specified voltage. Herein, absolute values of voltages applied to the EL elements for emitting light therefrom are set equal to or higher than a specified voltage between (Vr) and (Vr−VM), where Vr>VM.

The driver for driving this display 1 is composed of driver ICs 2, 3 and 4 for applying driving voltages to the scanning electrodes 201, 202, etc. of odd numbered lines, the scanning electrodes 301, 302, etc. of even numbered lines and the data electrodes 401, 402, etc. respectively, scanning voltage supplying circuits 10 and 20 for supplying positive and negative scanning voltages for reverse-driving the display 1 to the scanning side driver ICs 2 and 3, a display voltage supplying circuit 30 for supplying display voltages for controlling light emission and nonemission of the EL elements 111, 112, 121, etc. to the data side driver IC 4 and a timing control circuit 50 for controlling the timing with which the driver ICs 2, 3 and 4 apply voltages to the respective electrodes and the timing with which voltages are supplied from the scanning voltage supplying circuits 10 and 20 to the driver ICs 2 and 3.

The scanning voltage supplying circuit 10 is for supplying a positive scanning voltage (Vr) to the scanning side driver ICs 2 and 3 via a positive voltage supplying line L1 and has a switching element 10*a* for applying the positive scanning voltage (Vr) (hereinafter called a positive voltage supplying switch) to the positive voltage supplying line L1 and a switching element 10*b* for grounding the positive voltage supplying line L1 (hereinafter called a positive voltage side grounding switch).

The other scanning voltage supplying circuit 20 is for supplying a negative scanning voltage (−Vr+VM) to the scanning side driver ICs 2 and 3 via a negative voltage supplying line L2 and has a switching element 20*a* for applying the negative scanning voltage (−Vr+VM) to the negative voltage supplying line L2 (hereinafter called a negative voltage supplying switch) and a switching element 20*b* for grounding the negative voltage supplying line L2 (hereinafter called a negative voltage side grounding switch).

The display voltage supplying circuit 30 is for supplying two voltages (VM) and (0V) to the data side driver IC 4 via a pair of voltage supplying lines L3 and L4, applying the display voltage (VM) to the voltage supplying line L3 and grounding the other voltage supplying line L4.

Each of the driver ICs 2, 3 and 4 which receive power from the voltage supplying circuits 10, 20 and 30 is composed of push-pull switching circuits S201, S202, etc., S301, S302, etc., and S401, S402, etc. corresponding to the electrodes 201, 202, etc., 301, 302, etc., and 401, 402, etc. of the display 1, respectively, and driver circuits 2*a*, 3*a*, 4*a*, respectively, each having a shift register or the like for successively operating the switching circuits in accordance with a control signal outputted from the timing control circuit 50.

Each of the switching circuits S201, S202, etc., S301, S302, etc., and S401, S402, S403, etc. is composed of P channel FETs (field effect transistors) P1, P3, etc., P2, P4, etc. and P41, P42, P43, etc. and N channel FETs N1, N3, etc., N2, N4, etc., and N41, N42, N43, etc.

In the scanning side driver ICs 2 and 3, the source side lines of the P channel FETs P1, P2, P3, P4, etc. are connected to the positive voltage supplying line L1 and the source side lines of the N channel FETs N1, N2, N3, N4, etc. are connected to the negative voltage supplying line L2, while in the data side driver IC 4 the source side lines of the P channel FETs P41, P42, P43, etc. are connected to the voltage supplying line L3 and the source side lines of the N channel FETs N41, N42, N43, etc. are connected to the voltage supplying line L4.

The P and N channel FETs constituting each switching circuit are MOS type FETs having parasitic diodes D which pass a current in a direction opposite to the direction of the current being controlled.

In the basic structure of the driver thus described, the operation of which will be compared with a preferred embodiment of the invention described later, the timing control circuit 50 outputs image display control signals to the driver ICs 2, 3 and 4 and the scanning voltage supplying circuits 10 and 20 based on an operation clock signal CLK, display data signal DISP and display synchronization signal SYNC, etc., and images, corresponding to the display data are displayed on the display 1 by selectively switching the FETs constituting the switching circuits within the driver ICs 2, 3 and 4 and the FETs constituting the switches within the scanning voltage supplying circuits 10 and 20.

Figures 3A, 3B, 3C, 3D, 3E, 3F, 3G, 3H, 3I, 3J, 3K:
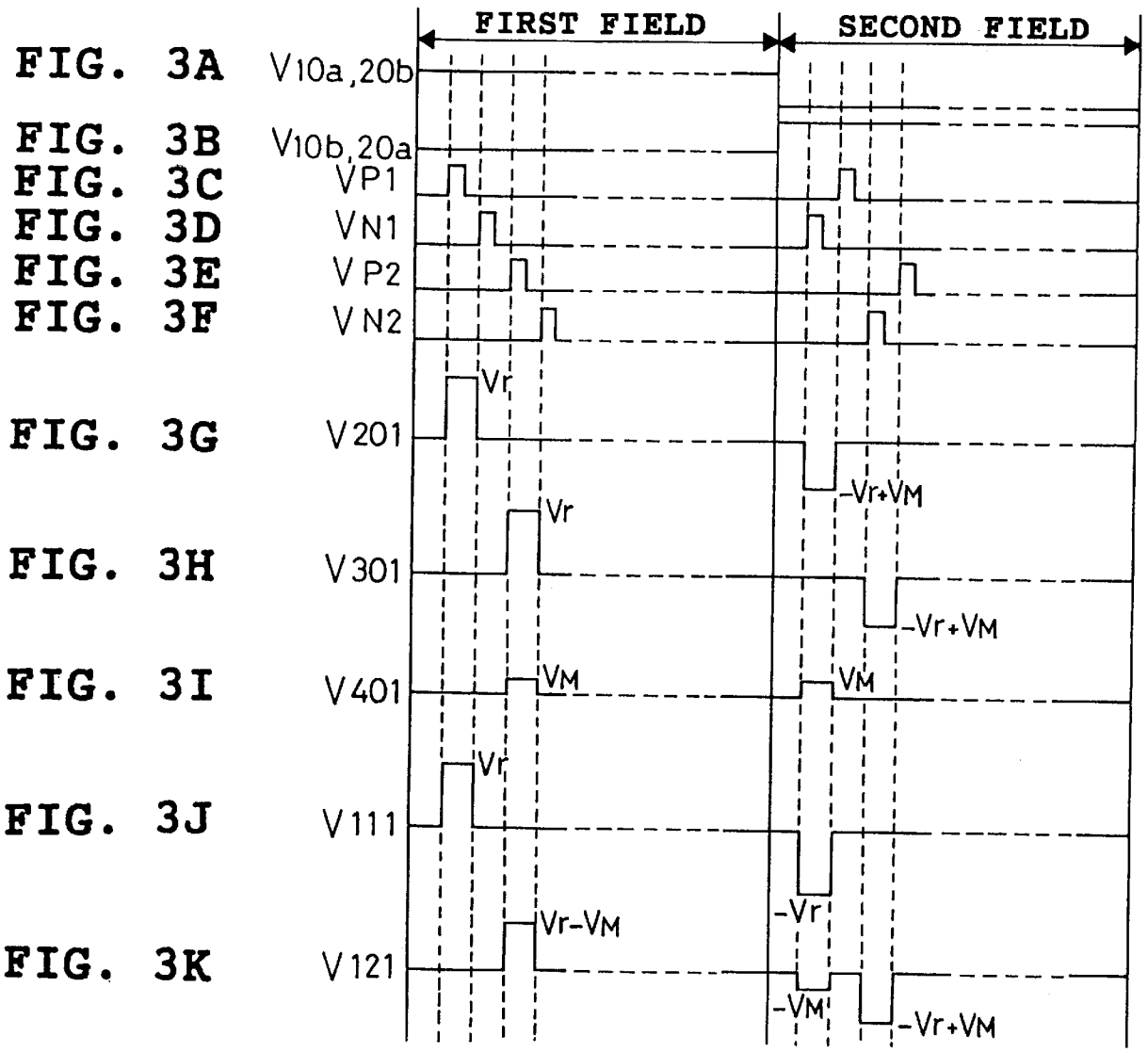
FIGS. 3A–3K are timing diagrams showing the EL display driver in an example for comparison.

More specifically, as shown in FIG. 3, as an example to be compared with a preferred embodiment of the invention, the timing control circuit 50 first sets the voltage positive voltage supplying line L1 at (Vr) and the negative voltage supplying line L2 at (0V) using $V_{10a}$ to switch the positive voltage supplying switch 10*a* and $V_{20b}$ to switch the negative voltage side grounding switch 20*b* within the scanning voltage supplying circuits 10 and 20 on and $V_{20a}$ to switch the negative voltage supplying switch 20*a* and $V_{10b}$ to switch the positive voltage side grounding switch 10*b* off.

Then, the voltage $V_{201}$ of the scanning electrode 201 on a first line is set at (Vr) by switching on the voltage $V_{P1}$ applied to the P channel FET P1 of the driver IC 2 connected thereto. At this time, all the voltages $V_{N1}$, $V_{P2}$, $V_{N2}$, etc. of FETs within the driver ICs 2 and 3 connected to the other scanning electrodes are switched off, thereby forcing the other scanning electrodes to floating states.

If voltages $V_{401}$, etc. applied to the data electrodes 401, 402, 403, etc. are set at (0V) at this time, voltages $V_{111}$, etc. to the EL elements 111, 112, etc. on a first line formed by the scanning electrode 201 and the data electrodes 401, 402, 403, etc. are (Vr) and light is emitted therefrom. On the other hand, if voltages $V_{401}$, etc. applied to the data electrodes 401, 402, 403, etc. are set at (VM), voltages $V_{111}$, etc. to the EL elements 111, 112, etc. on the first line are (Vr−VM) and no light is emitted therefrom. For this reason, the timing control circuit 50 switches on the P channel FETs P41, P42, P43, etc. or the N channel FETs N41, N42, N43, etc. within the driver IC 4 connected to the data electrodes 401, 402, 403, etc. according to display data on the first line of a display image and controls voltages of the data electrodes 401, 402, 403, etc. at (0V) or (VM).

For example, in a case where light is emitted from the EL element 111 in the first row of the first line, the N channel FET N41 connected to the data electrode 401 is switched on and a voltage $V_{401}$ applied to the data electrode 401 is set at (0V) as shown in FIG. 3. Consequently, a voltage (Vr) is applied to the EL element 111 as voltage $V_{111}$ and light is emitted therefrom.

Then, when display control is finished for the EL elements 111, 112, etc. on the first line, the voltage $V_{P1}$ applied to the P channel FET P1 within the driver IC 2 connected to the scanning electrode 201 on the first line is switched off while the voltage $V_{N1}$ applied to the N channel FET N1 is switched on and thus the voltage $V_{201}$ on scanning electrode 201 is grounded via the negative voltage side grounding switch 20*b* and electric charge stored in the EL elements 111, 112, etc. on the scanning electrode 201 are discharged by above-mentioned voltage application.

When discharging of electric charge from the EL elements 111, 112, etc. on the first line is completed, the voltage $V_{P2}$ on the P channel FET P2 within the driver IC 3 connected to the scanning electrode 301 on the second line is switched on and a voltage thereof is set at (Vr) while all the FETs within the driver ICs 2 and 3 connected to the other scanning electrodes are switched off and the other scanning electrodes are forced to floating states.

Moreover, at this time, the timing control circuit 50 witches on the P channel FETs P41, P42, P43, etc. or the N channel FETs N41, N42, N43, etc. within the driver IC 4 connected to the data electrodes 401, 402, 403, etc. according to display data on the second line of the display image and voltages thereto are controlled at (0V) or (VM).

As another example, in a case where no light is to be emitted from the EL element 121 in the first row of the second line, the P channel FET P41 connected to the data electrode 401 is switched on and a voltage $V_{401}$ applied to the data electrode 401 is set at (VM) as shown in FIG. 3. Consequently, a voltage (Vr−VM) is applied to the EL element 121 as voltage $V_{121}$ and no light is emitted therefrom.

When display control for the EL element 121 on the second line is thus completed, the voltage $V_{P1}$ on the P channel FET P1 within the driver IC 3 connected to the scanning electrode of the line is switched off while the voltage $V_{N1}$ on the N channel FET N1 is switched on and thereby the voltage $V_{301}$ to scanning electrode 301 is grounded via the negative voltage side grounding switch 20*b* and electric charge stored in the EL element 121 on the scanning electrode 301 is discharged by the above-mentioned voltage application.

The timing control circuit 50 repeatedly performs light emission of the EL elements and subsequent discharging with respect to the scanning electrodes on a third line and subsequent lines, and when discharging from the EL element on the last line is completed, that is, when the display control of the first field for displaying an image of one screen is completed, the timing control circuit 50 sets the positive voltage supplying line L1 at (0V) and the negative voltage supplying line L2 at (−Vr+VM) by switching off the positive voltage supplying switch 10*a* and the negative voltage side grounding switch 20*b* within the scanning voltage supplying circuits 10 and 20 and switching on the negative voltage supplying switch 20*a* and the positive voltage side grounding switch 10*b* in order to reverse the polarities of voltages applied to the EL elements 111, 112, 121, etc. in the next second field.

In this second field, the timing control circuit 50 applies voltages to the scanning electrodes 201, 301, 202, 302, etc. by switching on the N channel FETs N1, N2, N3, N4, etc. within the scanning side driver ICs 2 and 3 and performs discharging from the EL elements on the respective lines 111, 112, 121, etc. by switching on the P channel FETs P1, P2, P3, P4, etc. within the scanning driver ICs 2 and 3.

When light is emitted from the EL elements 111, 112, 121, etc., the timing control circuit 50 switches on the P channel FETs P41, P42, P43, etc. within the data side driver IC 4 synchronously with the timings of switching on the N channel FETs N1, N2, N3, N4, etc. within the scanning side driver ICs 2 and 3, and conversely, when light is to be emitted therefrom, it switches on the N channel FETs N41, N42, N43, etc. within the data side driver IC 4.

More specifically, in a case where light is to be emitted from the EL element 111 in the first row of the first line in the second field as in the case of the first field, the timing control circuit 50 applies a voltage $V_{201}$ (−Vr+VM) to the scanning electrode 201 on the first line by switching on the voltage $V_{N1}$ to the N channel FET N1 within the driver IC 2, and simultaneously switches on the P channel FET P41 in the driver IC4 and applies a voltage $V_{401}$ (VM) to the data electrode 401. Consequently, a voltage $V_{111}$ (−Vr) having polarity (negative) opposite to its voltage in the first field is applied to the EL element 111 in the first row of the first line and light is emitted therefrom.

In the second field, in a case where no light is to be emitted from the EL element 121 in the first row of a second line as in the case of the first field, a voltage $V_{301}$ (−Vr+VM) is applied to the scanning electrode 301 on the second line by switching on the N channel FET N2 within the driver IC 3, and at the same time the voltage $V_{401}$ on the data electrode 401 is grounded by switching on the N channel FET N41 within the driver IC 4. Consequently, a voltage $V_{121}$ (−Vr+VM) having a polarity opposite to its polarity in the first field is applied to the EL element 121 in the first row of the second line and no light is emitted therefrom.

When display control for the second field is completed, to remove the polarity of the voltage impressed on the El, elements 111, 112, 121, etc. in the next field the timing control circuit 50 switches on the positive voltage supplying switch 10*a* and the negative voltage side grounding switch 20*b* within the scanning voltage supplying circuits 10 and 20, switches off the negative voltage supplying switch 20*a* and the positive voltage side grounding switch 20*b*, and performs the same control as in the case of the first field and thereafter repeatedly executes the display control of the first and second fields described above.

As described in detail above, in the example for comparison illustrating the basic structure of an EL display driver, positive or negative scanning voltages are successively and synchronously applied to the scanning electrodes thereof, light emission and nonemission of EL elements constituting the EL display are controlled by controlling the voltages of the data electrodes in accordance with data to be displayed, and moreover all electric charges stored as a result of voltage application are discharged from the respective EL elements on display lines before switching each time scanning voltages are applied and the scanning electrodes (display lines) for controlling light emission and nonemission are switched.

On the other hand, in the driving device of the EL display in the present embodiment, which is improved with respect to the above-mentioned example for comparison, a floating timing control circuit 50A effecting different timings for controlling the scanning side driver ICs 2 and 3 and the scanning voltage supplying circuits 10 and 20 and an initialization timing circuit 50B are added to the driving device shown in FIG. 2.

Figures 1A, 1B, 1C, 1D, 1E, 1F, 1G, 1H, 1I, 1J:
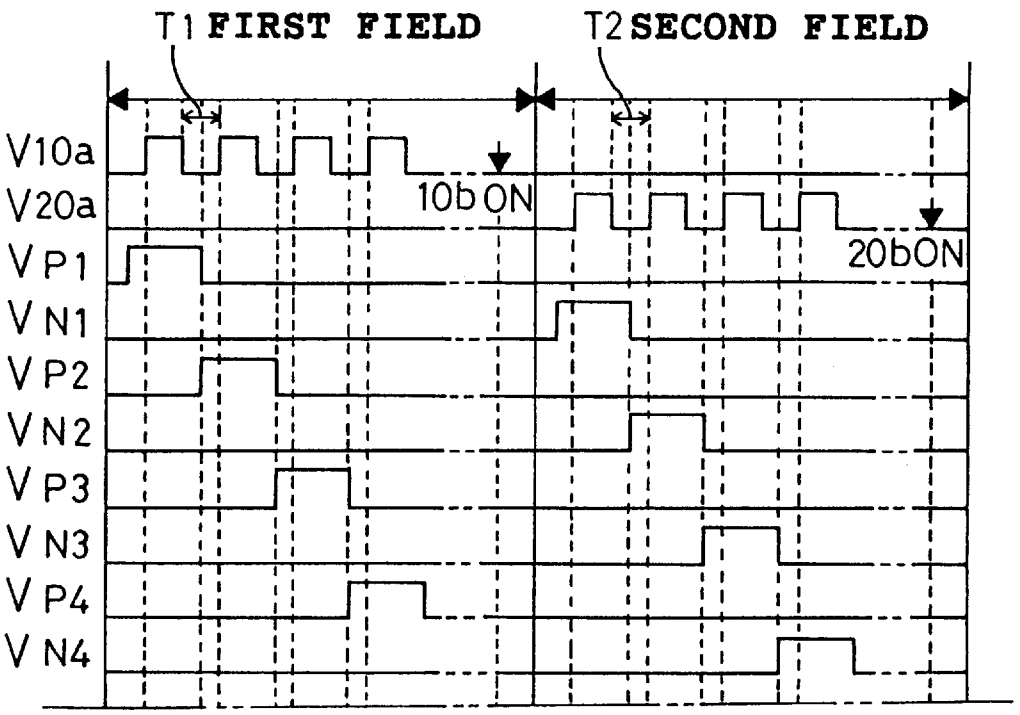
FIGS. 1A–1P are timing diagrams illustrating the operation of an EL display driver according to a preferred embodiment of the present invention.
Figures 1K, 1L, 1M, 1N, 1O, 1P:
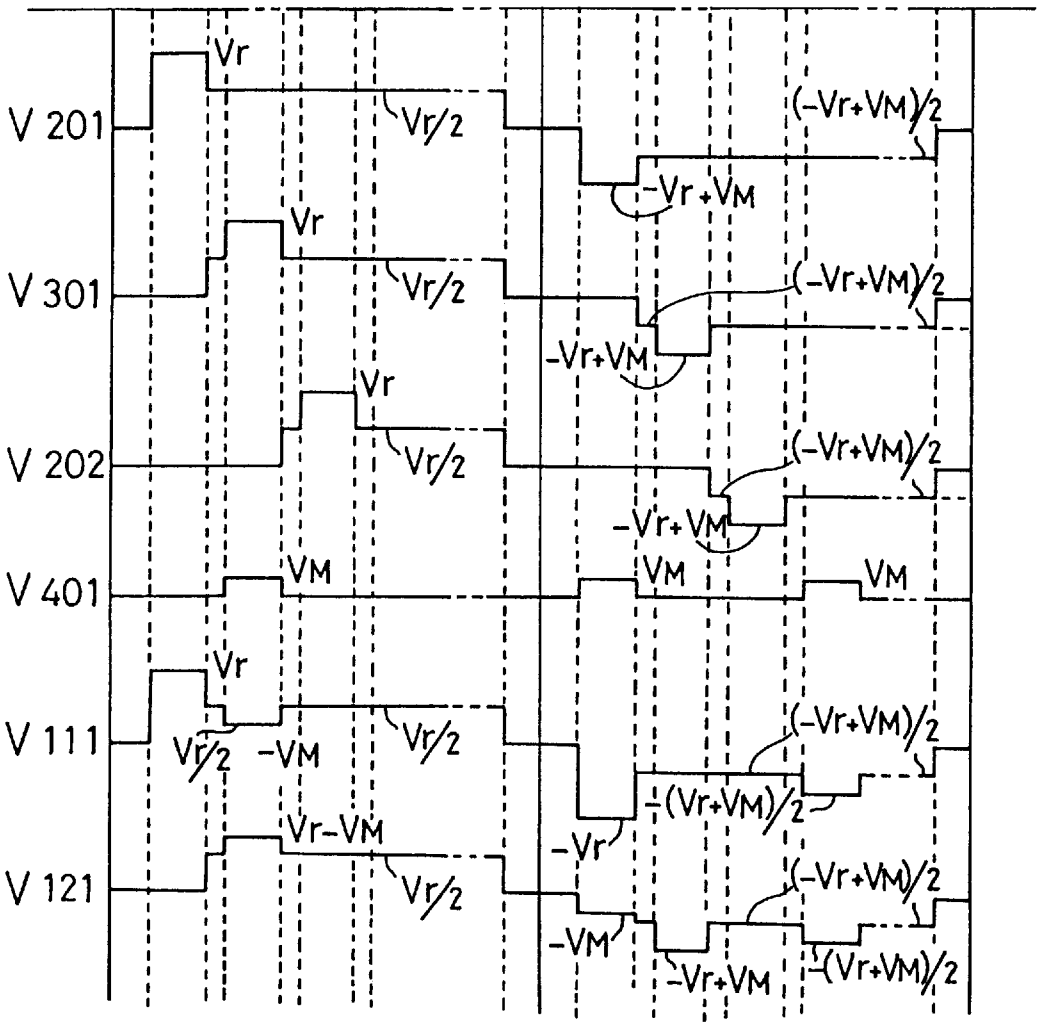

The detailed explanation will now be made of the operation of each part of the driver on the scanning electrode side controlled by the timing control circuit 50 in the present embodiment with reference to timing diagrams shown in FIGS. 1A–1P.

As in the case of the driver in the example for comparison, the driver in the present embodiment reverses the polarities of voltages applied to the EL elements 111, 112, 121, etc. each time the display control of one field for displaying an image of one screen is finished and for this reversal driving the timing control circuit 50 cyclically switches the positive voltage supplying switch 10*a* on and off within the scanning voltage supplying circuit 10 by a voltage impressing pulse whose level is cyclically changed between high and low synchronously with the scanning timing in the first field where positive voltage driving is performed and cyclically switches the negative voltage supplying switch 20*a* within the scanning voltage supplying circuit 20 on and off using that voltage impressing pulse in the second field where negative voltage driving is performed.

That is, as shown in FIG. 2, in the driver of the present embodiment, the timing control circuit 50 is provided with the floating timing control circuit 50A, so that the voltage impressing pulse is controlled. Thus, in the first field where the positive voltage driving is performed, the switches 10*a* and 10*b* within the scanning voltage supplying circuit 10 are simultaneously switched off and the positive voltage supplying line L1 is put in a floating state (T1 in FIG. 1) at the time of switching scanning lines, and in the second field where the negative voltage driving is performed, the switches 20*a* and 20*b* within the scanning voltage supplying circuit 20 are simultaneously switched off and the negative voltage supplying line L2 is put in a floating state (T2 in FIG. 1) at the time of switching scanning lines.

Light emitting operation in the first field and on the first line will now be described.

As shown in FIG. 1, the timing control circuit 50 first switches on the voltage $V_{P1}$ to the P channel FET P1 within the driver IC 2 connected to the scanning electrode 201 on the first line in the state where all the voltages $V_{10a}$, $V_{20a}$, etc. corresponding to switches 10*a*, 10*b*, 20*a* and 20*b* within the scanning voltage supplying circuits 10 and 20 are kept off, and then starts outputting the voltage impressing pulse. Consequently, at the time when the positive voltage supplying circuit 10*a* is switched on, a positive scanning voltage (Vr) is applied to the positive voltage supplying line L1 and thereby as a voltage $V_{201}$ to the scanning electrode 201.

At this time, the timing control circuit 50 controls light emission and nonemission from the EL elements 111, 112, etc. on the first line corresponding to display data thereon as in the case of the example for comparison illustrated in FIGS. 3A–3K.

Electric charge movement from the first line to the second line in the first field will now be described.

When the operation of light emission from the EL elements 111, 112, etc. on the first line is finished, the positive voltage supplying circuit 10*a* is switched off again by the floating timing control circuit 50A. That is, the positive voltage supplying circuit L1 is put in a floating state by simultaneously switching off both switches 10*a* and 10*b* within the scanning voltage supplying circuit 10.

After a specified amount of time has passed, the timing control circuit 50 switches off the voltage $V_{P1}$ to the P channel FET P1 within the driver IC 2 connected to the scanning electrode 201 on the first line and switches on the voltage $V_{P2}$ to the P channel FET P2 within the driver IC 3 connected to the scanning electrode 301 on the second line.

Thus, since the positive voltage supplying line L1 is in a floating state at this time, part of the electric charge stored in the EL elements 111, 112, etc. on the first line at the time of the previous light emission gets into the scanning electrode 301 on the second line via the parasitic diode D of the P channel FET P1, the positive voltage supplying line L1 and the P channel FET P2, and though the voltages $V_{201}$ and $V_{301}$ of the scanning electrodes 201 and 301 fluctuate according to the ratio of light emitting pixels on the first line, they become (Vr/2), about half the positive scanning voltage (Vr), and an electric charge roughly equivalent to (Vr/2) is stored in the EL elements on the first and second lines.

Light emitting operation in the first field on the second line will now be described.

When the voltage $V_{P2}$ to the P channel FET P2 within the driver IC 3 connected to the scanning electrode on the second line is switched on and transfer of electric charge from the first to the second line is completed, the positive voltage supplying switch 10*a* is switched on using the voltage impressing pulse and the positive scanning voltage (Vr) is applied to the positive voltage supplying line L1 again.

At this time, the data side driver IC 4 is controlled according to display data on the second line and light emission and nonemission of the EL elements 121, etc. thereon is controlled as in the case of the example for comparison shown in FIG. 3.

Further, at this time, a voltage of about (Vr/2−VM) is applied, of the EL elements 111, 112, etc. on the first line, to the one of the data electrodes for which the P channel FET within the data side driver IC 4 is switched on, because no light is emitted on the second line, for example, to the EL element 111 formed by the data electrode 401, and conversely a voltage of about (Vr/2) is applied to the EL element formed by the data electrode for which the N channel FET within the data driver IC 4 is switched on because light is to be emitted on the second line. However, these voltages applied to the EL elements are below a voltage necessary for emitting light, and therefore no light is emitted from the EL elements. The same operation is repeated thereafter until reaching the scanning electrode on the last line.

The initializing operation after the first field is finished will now be described.

When display control for the EL element on the last line is completed, that is, display control in the first field wherein the display of an image of one screen is performed by applying a positive voltage $V_{201}$, $V_{301}$ (Vr) to the scanning electrodes 201, 301, etc. is completed, the initialization timing control circuit 50B provided within the timing control circuit 50 switches on the positive voltage side grounding switch 10*b* within the scanning voltage supplying circuit 10, grounds the positive voltage supplying line L1 and thereby grounds all the scanning electrodes 201, 301, etc. via the parasitic diode D.

More specifically, when display control for the first field is finished, the initialization timing control circuit 50B within the timing control circuit 50 performs an initializing operation for discharging all electric charges equivalent to about (Vr/2) remaining in the EL element of the display 1 by switching the positive voltage side grounding switch 10*b* on.

The light emitting operation in the second field on the first line will now be explained.

When the initializing operation after finishing the first field is completed, the timing control circuit 50 switches voltages $V_{201}$, $V_{301}$, $V_{202}$, etc. applied to the scanning electrodes 201, 301, 202, 302, etc. from the positive scanning voltage (Vr) to the negative scanning voltage (−Vr+VM) by switching the place to which the voltage impressing pulse is outputted from the positive voltage supplying switch 10*a* side to the negative voltage supplying switch 20*a* side and moves to a light emitting operation in the second field.

Then, as shown in FIG. 1, when it moves to the light emitting operation in the second field, the timing control circuit 50 first uses voltage $V_{N1}$ to switch on the N channel FET N1 within the scanning side driver IC 2 before the level of the voltage impressing pulse becomes low, that is, a scanning voltage (−Vr+VM) is applied to the negative voltage supplying line L2. Consequently, when the level of the voltage impressing pulse becomes high thereafter, the negative scanning voltage (−Vr+VM) is applied to the negative voltage supplying line L2, and thereby to the scanning electrode 201. At this time, all the FETs within the driver ICs 2 and 3 connected to the other electrodes are switched off and the other scanning electrodes are put in floating states.

At this time, the timing control circuit 50 controls the driver IC 4 according to display data on the first line, applies a voltage (VM) to data electrodes corresponding to EL elements from which light is to be emitted on the first line and a voltage (0V) to data electrodes corresponding to EL elements from which no light is to be emitted on the first line and thereby controls light emission and nonemission from the EL elements 111, 112, etc. on the first line as in the case of the example for comparison shown in FIG. 3. Consequently, a voltage between the electrodes of the EL elements from which light is to be emitted becomes (−Vr) and thus light is emitted therefrom while that between the electrodes of the EL elements from which no light is to be emitted becomes (−Vr+VM) and no light is emitted therefrom.

The operation of moving electric charge from the first line to the second line in the second field will now be explained.

When the light emitting operations of the EL elements 111, 112, etc. on the first line are finished, the floating timing control circuit 50A changes the voltage impressing pulse to a low level and thereby the negative voltage supplying switch 20*a* is switched off again. That is, in the second field, the negative voltage supplying line L2 is put in a floating state by simultaneously switching off both switches 20*a* and 20*b* within the scanning voltage supplying circuit 20. Then, after a specified passage of time from when the negative voltage supplying line L2 is put in a floating state, the timing control circuit 50 switches off the voltage $V_{N1}$ to the N channel FET N1 within the driver IC 2 connected to the scanning electrode 201 on the first line and switches on the voltage $V_{N2}$ to the N channel FET N2 within the driver IC 3 connected to the scanning electrode 301 on the second line. At this time, all the FETs within the driver ICs 2 and 3 connected to the other scanning electrodes are kept off.

Thus, since the negative voltage supplying line L2 is in a floating state at this time, a current flows from a grounding line to the scanning electrode 201 side on the first line via the N channel FET N2, the negative voltage supplying line L2 and the parasitic diode D of the N channel FET N1 and thereby part of the electric charge stored in the EL elements 111, 112, etc. on the first line gets around to the scanning electrode 301 side on the second line at the time of the previous light emitting operation. Though voltages applied to the scanning electrodes 201, 301, etc. fluctuate according to the ratio of light emitting pixels on the first line, they become about ((−Vr+VM)/2), or about half the scanning voltage (−Vr+VM) applied to the scanning electrode on the first line and an electric charge roughly equivalent to the voltage ((−Vr+VM)/2) is stored in the EL elements on the first and second lines.

The light emitting operation in the second field on the second line will now be described.

When the N channel FET N2 within the driver IC 3 connected to the scanning electrode 301 on the second line is switched on and transfer of electric charge from the first to the second line is completed, the negative voltage supplying switch 20*a* is switched on using the voltage impressing pulse and the negative scanning voltage (−Vr+VM) is applied to the negative voltage supplying line L2. At this time, the timing control circuit 50 controls light emission and nonemission from the EL elements on the second line by controlling the driver IC 4 according to display data on the second line and applying a voltage (VM) to data electrodes corresponding to EL elements from which light is to be emitted on the second line and a voltage (0V) to data electrodes corresponding to EL elements from which no light is to be emitted thereon as in the case of the example for comparison shown in FIG. 3.

The same operation is repeated thereafter until reaching the scanning electrode of the last line.

The initializing operation after the second field is finished will now be explained.

When display control with respect to the EL element on the last line is completed, that is, when display control for the second field wherein display of an image of one screen is performed by applying a negative voltage (−Vr+VM) to the scanning electrodes 201, 301, etc. is completed, the initialization timing control circuit 50B provided within the timing control circuit 50 switches on the negative voltage side grounding switch 20*b* within the scanning voltage supplying circuit 20, grounds the negative voltage supplying line L2 and thereby grounds all the scanning electrodes 201, 301, etc. via the parasitic diode D.

More specifically, when display control for the second field is finished, as in the case of the first field, the initialization timing control circuit 50B within the timing control circuit 50 performs an initializing operation for discharging all electric charge equivalent to about ((−Vr+VM)/2) remaining in the EL element of the display 1 by switching the negative voltage side grounding switch 20*b* on.

Then, when the initializing operation at the time of finishing the second field is completed, the timing control circuit 50 switches voltages $V_{201}$, $V_{301}$, etc. applied to the scanning electrodes 201, 301, etc. from the negative scanning voltage (−Vr+VM) to the positive scanning voltage (Vr) by switching the place to which the voltage impressing pulse is outputted from the negative voltage supplying switch 20*a* side to the positive voltage supplying switch 10*a* side, performs the same display control as in the first field and repeatedly executes the display control for the first and second fields thereafter.

As described above, in the driving device of the EL display in the first embodiment, when the display 1 is driven by a positive voltage, the scanning electrodes for supplying the scanning voltages from the positive voltage supplying line L1 are selected by successively using voltages $V_{P1}$, $V_{P2}$, $V_{P3}$, $V_{P4}$, etc. to switch on the P channel FETs P1, P2, P3, P4, etc. within the scanning side driver ICs 2 and 3 in synchronously with a prescribed scanning timing, and on the other hand, in a case where the display 1 is driven by a negative voltage, the scanning electrodes for supplying the scanning voltages from the negative voltage supplying line L2 are selected by using voltages $V_{N1}$, $V_{N2}$, $V_{N3}$, $V_{N4}$ to successively switch on the N channel FETs N1, N2, N3, N4, etc. within the scanning side driver ICs 2 and 3 synchronously with a prescribed scanning timing. Further, separately from these scanning electrode selecting operations, by applying a voltage impressing pulse whose level becomes high for a certain period of time during the middle of the period for selecting for each scanning electrode the positive voltage supplying switch 10*a* or the negative voltage supplying switch 10*b* in synchronously with the scanning electrode selecting operations (in other words, the scanning timing), a positive voltage is applied to the selected scanning electrode when the display 1 is driven by a positive voltage and a negative voltage is applied to the selected scanning electrode when the display 1 is driven by a negative voltage.

Thus, by controlling display voltages $V_{401}$, etc. applied from the data side driver IC 4 to the data electrodes 401, 402, 403, etc. at either (0V) or (VM) during application of the scanning voltages, light emission and nonemission from the EL element formed by the selected scanning electrodes can be controlled and thus a predetermined image can be displayed on the display 1.

Moreover, in the first embodiment, by controlling application of the scanning voltage to each scanning electrode using the voltage impressing pulse for switching the voltage supplying switch 10*a* or 10*b* on and performing switching of the scanning electrodes for applying the scanning voltages when the level of the voltage impressing pulse is low, in other words by generating a floating state using the floating timing control circuit 50A wherein no scanning voltages are applied to the voltage supplying lines L1 and L2, part (about half) of the electric charge stored in the EL element on the scanning electrode side for which display control is finished is directly moved to the EL element on the scanning electrode side for which display control is subsequently performed via the power supplying line L1 or L2 prior to application of the scanning voltage thereto.

Thus, according to the embodiment, since roughly half the electric charge necessary for driving the EL elements is already stored in the EL element formed by the subsequent scanning electrode at the time of applying the scanning voltage thereto, compared with a device which discharges electric charge stored in the EL element on a given line without any changes whenever control for each scanning electrode is finished as in the case of the above-mentioned example for comparison, the amount of electric power consumed at the time of applying a voltage to each scanning electrode, and therefore the amount of power consumed for driving the EL display can be further reduced.

Moreover, since transfer of electric charge is performed by only providing the floating timing control circuit 50A for changing the on and off timings of the elements within each circuit in the timing control circuit 50 without specially changing the structures of the scanning side driver ICs 2 and 3 and the scanning voltage supplying circuits 10 and 20, transfer can be realized extremely easily without providing a capacitor circuit or the like for reducing electric power consumption on the data electrode side and without complicating the structure and control as in a conventional device.

Furthermore, in the preferred embodiment, each time display control for all the scanning electrodes is finished, that is, each time the display control of one field is finished, the electric charge remaining in all the EL elements of the display 1 is discharged by switching on the grounding switch 10*b* or 20*b* within the scanning voltage supplying circuit 10 or 20 using the initialization timing control circuit 50.

Here, in the preferred embodiment described above, a driver drives a thin film EL display having EL elements arranged in two dimensions by forming mutually orthogonal scanning electrodes and data electrodes on the surfaces of an EL display layer, where the driver is capable of displaying 2-dimensional images; however, the invention can be applied to any driving device which drives EL elements arrayed in one or two dimensions, irrespective of the EL element material, film formation technique and the like.

Thus far, explanation has been made of devices using FETs as switching elements for switching voltages applied to each electrode in the driver ICs 2, 3 and 4 with reference to the preferred embodiment. However, as switching elements, thyristors, bipolar transistors, etc., can be used instead of FETs.

Furthermore, in the explanation of the above-mentioned embodiment, reference was made to a device for reverse-driving the display 1 by controlling voltages applied to the scanning electrodes at (Vr) and (−Vr+VM) and voltages applied to the data electrodes at (VM) and (0V). However, the display 1 may be reverse-driven by controlling, for example, voltages applied to the scanning electrodes at (Vr−VM/2) and (−Vr+VM/2) and those applied to the data electrodes at (VM/2) and (−VM/2).

The application of the present invention is not limited to drivers for such a reverse-driving system. It also can be applied to a driving device for performing so-called refreshing driving for preventing polarization of the EL elements by applying refreshing voltages having polarities different from when images are displayed across the scanning electrodes and the data electrodes each time display control for one field is finished. In a case where this refreshing driving is performed, an open drain output type IC may be used for the scanning side driver IC.

Furthermore, in the above-described embodiment, electric charge remaining in all the EL elements of the display 1 is discharged by switching the grounding switch 10*b* or 20*b* on using a control signal outputted from the timing control circuit 50 whenever display control for one field is finished. This discharging operation may, however, be performed for every scanning electrode after moving electric charge to a subsequent line or a plurality of scanning electrodes collecting several lines together. In this way, the period of time for storing electric charge in the EL element can be shortened more than in the case of the above-mentioned embodiment, thereby improving the durability thereof. In a case where electric charge is discharged for every scanning electrode, the grounding switches 10*b* and 20*b* may be switched on using an externally inputted horizontal synchronizing signal for image display.

Moreover, in the above-described preferred embodiment, part of the electric charge stored in the EL element for which display control is finished is moved to that on the subsequent scanning electrode side by setting the positive voltage supplying line L1 or the negative voltage supplying line L2 in a floating state using the floating timing control circuit 50A and directly connecting the scanning electrode thereof to that for which display control is subsequently performed after display control for each scanning electrode is finished. However, since all the electric charge stored in the EL element on the last line (last scanning electrode) to which a scanning voltage is applied at the end of each field are discharged by the discharging operation of the refreshing timing control circuit 50B thereafter, it is necessary to charge electric charge equivalent to a scanning voltage needed for display control to the EL element formed by the scanning electrode on the first line at the time of starting display control for each field.

Figure 4:
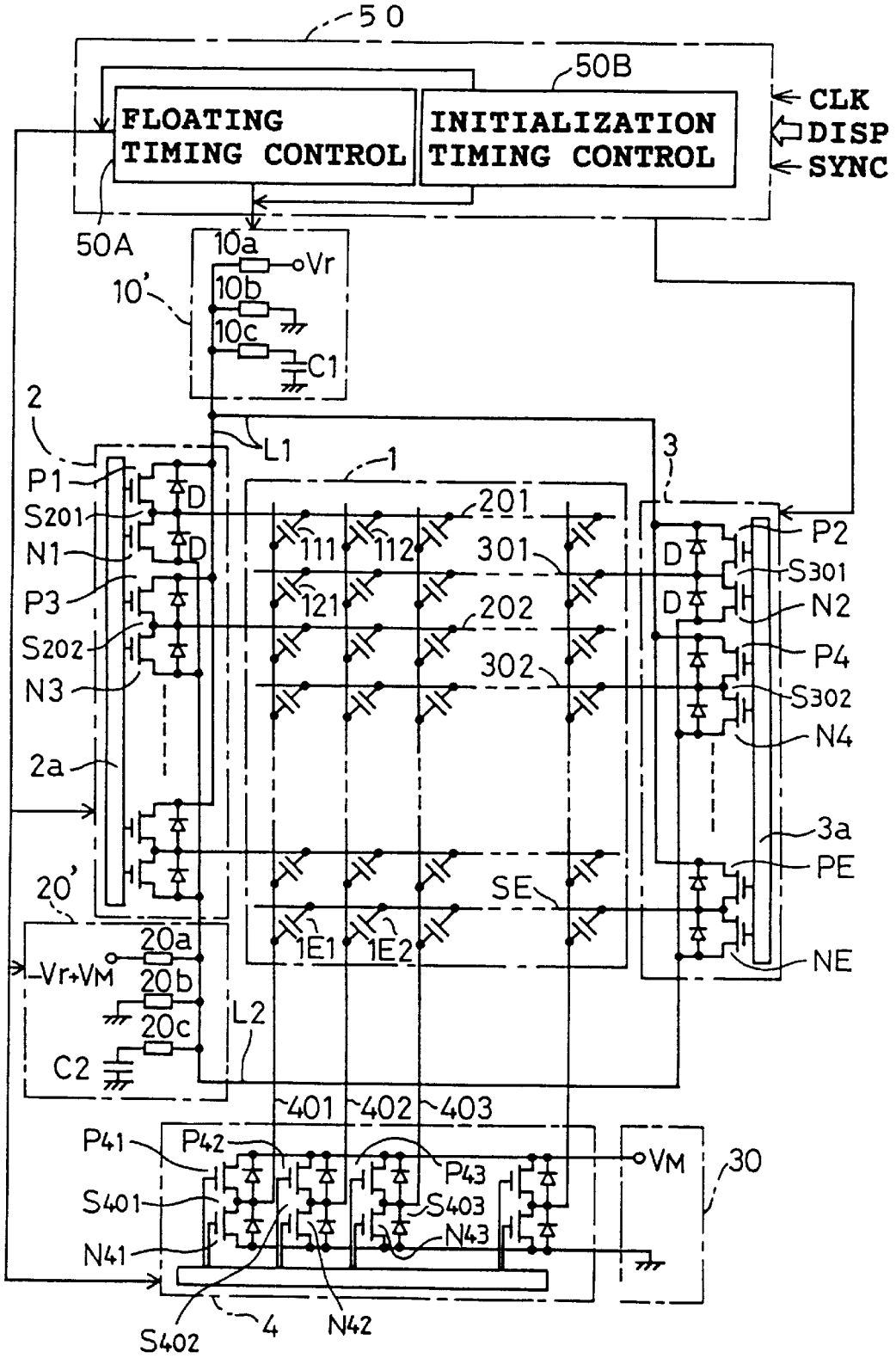
FIG. 4 is a schematic diagram of an EL display according to a second preferred embodiment.

To deal with this, in a second preferred embodiment of the present invention the scanning voltage supplying circuits 10 and 20 of the driving device shown in FIG. 2 may be changed, as shown in FIG. 4, to the scanning voltage supplying circuits 10' and 20' respectively provided with capacitors C1 and C2, each having one end grounded with capacities sufficiently larger (e.g., a capacity of about ten times as large) as the collective capacitance of the EL element formed by each scanning electrode and capacitor connecting switches 10*c* and 20*c* for connecting the other end thereof to the power supplying lines L1 and L2 to generate voltages $V_{10c}$ and $V_{20c}$, part of the electric charge stored in the EL element formed by a last scanning electrode SE may be temporarily moved to the capacitors C1 and C2 by switching the capacitor connecting switch 10*c* or 20*c* on when application of a scanning voltage thereto is finished, and when control for one field is started thereafter, electric charge stored in the capacitors C1 and C2 may be moved to the scanning electrode side 201 on the first line by switching the capacitor switch 10*c* or 20*c* on prior to the application of the scanning voltage thereto.

Figures 5A, 5B, 5C, 5D, 5E, 5F, 5G, 5H, 5I, 5J, 5K, 5L, 5M, 5N, 5O, 5P, 5Q, 5R, 5S, 5T:
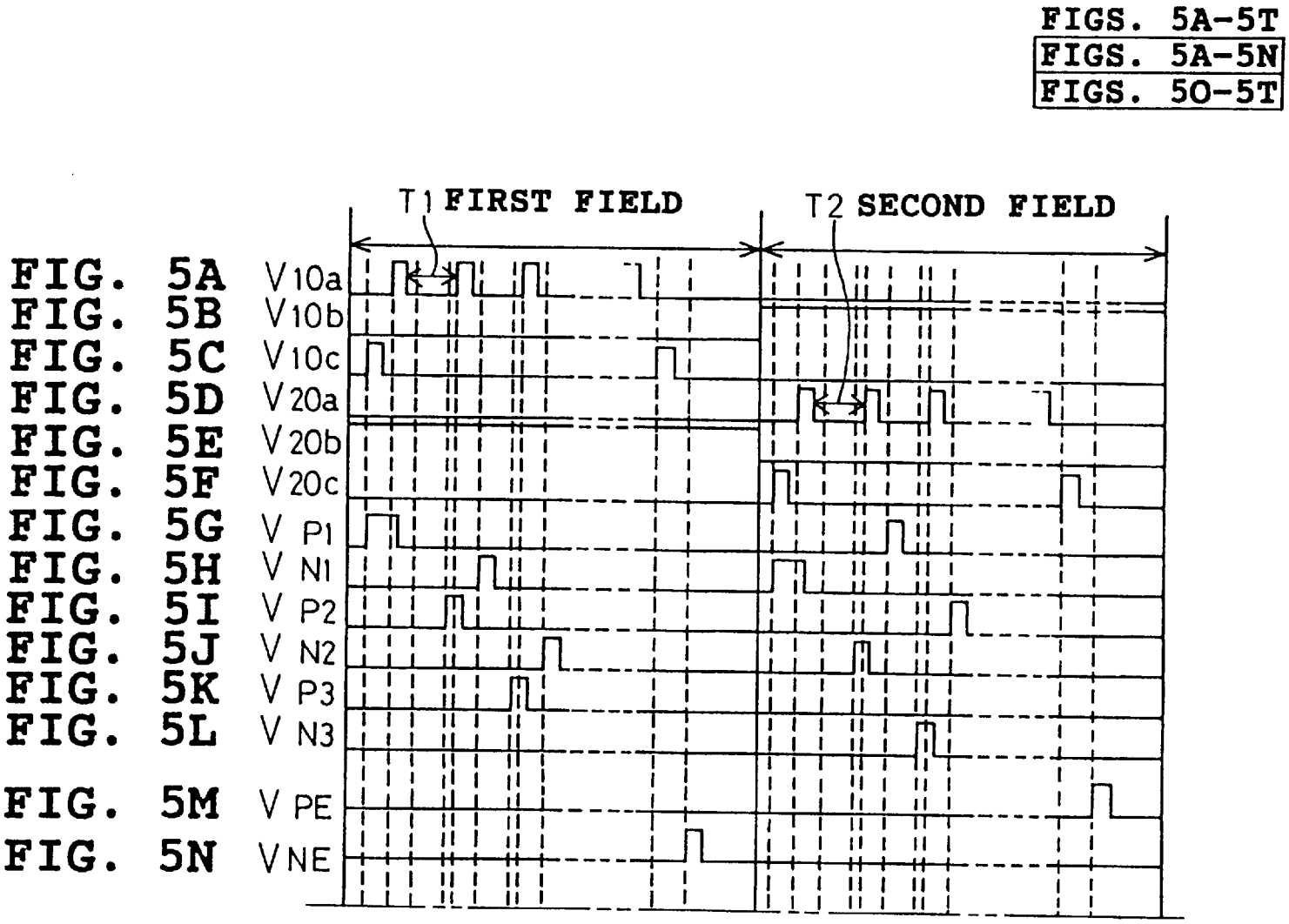
FIGS. 5A–5T are timing diagrams showing an example of the operation of the driving device of FIG. 4.

The following describes one example of the operation of the driver for moving electric charge stored in the EL element formed by the last scanning electrode SE to the scanning electrode 201 on the first line via the capacitors C1 and C2 having the capacitors C1 and C2 and the capacitor connecting switches 10*c* and 20*c* within the scanning voltage supplying circuits 10' and 20' with reference to the timing diagrams shown in FIGS. 5A–5T.

The examples shown in FIGS. 5A–5T show the operation of the driver for discharging electric charge remaining in the EL element for every scanning electrode after a scanning voltage is applied thereto and electric charge is moved to a subsequent scanning electrode. In the operation explained hereinbelow, as in the case of the above-mentioned embodiment, the on and off timings of the switches and the FETs are controlled by a control signal from the timing control circuit 50.

First, the light emitting operation in the first field on the first line will be described.

Figures 5O, 5P, 5Q, 5R, 5S, 5T:
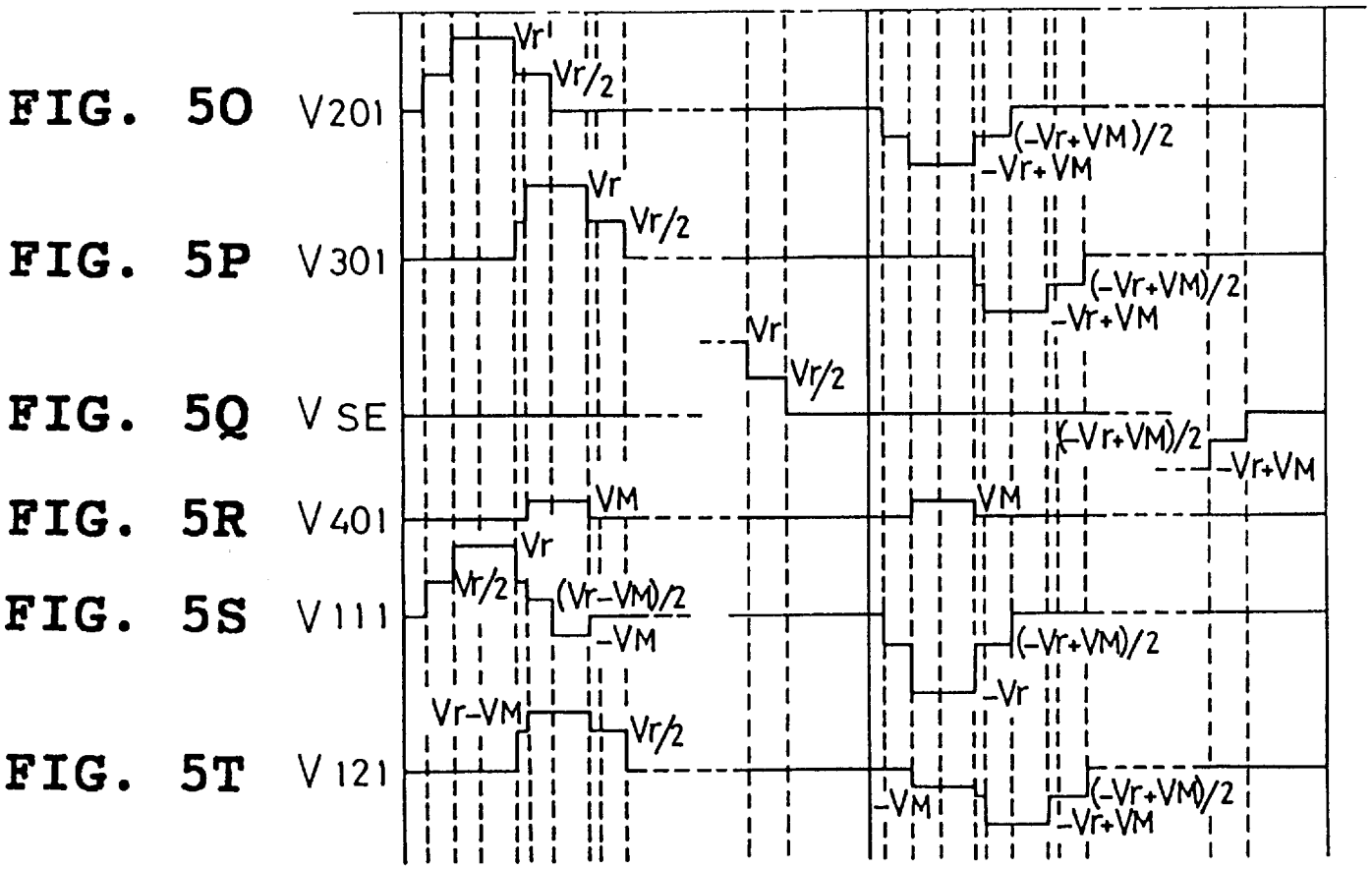

As shown in FIG. 5, at the time of starting control for the first field, the timing control circuit 50 first switches on the negative voltage side grounding switch 20*b* within the scanning voltage supplying circuit 20 and grounds the negative voltage supplying circuit L2. This negative voltage grounding switch 20*b* is kept in an on state while the display control for the first field is in operation.

Then, the timing control circuit 50 switches on the capacitor connecting switch 10*c* within the scanning voltage supplying circuit 10 and the P channel FET P1 within the driver IC 2 connected to the scanning electrode 201 on the first line and moves part of the electric charge stored in the capacitor C1 to the EL elements 111, 112, etc. thereon.

More specifically, voltages on both ends of the capacitor C1 become the voltage (Vr/2) of about half the scanning voltage (Vr) by repeating an operation explained below, electric charge equivalent to this voltage (Vr/2) is stored, and since the capacitance of the capacitor C1 is sufficiently larger than the collective capacitance of the EL elements 111, 112, etc. formed by the scanning electrode 201, when the capacitor connecting switch 10*c* and the P channel FET P1 are switched on as in the above, the voltage to the scanning electrode 201 on the first line becomes (Vr/2) and electric charge equivalent to (Vr/2) is stored in the EL elements 111, 112, etc.

Then, the timing control circuit 50 switches the capacitor connecting switch 10*c* off and starts outputting the voltage impressing pulse to the positive voltage supplying switch 10*a*. Consequently, the scanning voltage (Vr) is applied to the scanning electrode 201. At this time, all the FETs within the driver ICs 2 and 3 connected to the other scanning electrodes are switched off and thus the other scanning electrodes are put in floating states.

Also, at this time, the timing control circuit 50 causes the data side driver IC 4 to apply display voltages $V_{401}$, etc. (0V) or (VM) corresponding to the display data of a display image on the first line to the data electrodes 401, 402, 403, etc. In this way, as in the case of the above-mentioned embodiment, light is emitted from the EL elements 111, 112, etc. on the first line in accordance with the display data.

When display control for these EL elements 111, 112, etc. on the first line is completed, the timing control circuit 50 switches the P channel FET P1 off. In the present embodiment, the floating timing control circuit 50A changes the voltage impressing pulse to a low level after the P channel FET P1 is switched off and thereby the positive voltage supplying switch 10*a* is switched off. That is, the floating timing control circuit 50A controls the positive voltage supplying circuit L1 in a floating state by simultaneously switching off both switches 10*a* and 10*b* within the scanning voltage supplying circuit 10.

The operation of moving electric charge from the first line to the second line in the first field will now be described.

The timing control circuit 50 switches on the P channel FET P2 within the driver IC 3 connected to the scanning electrode 301 on the second line. Thus, since the positive voltage supplying line L1 is in a floating state at this time, part of the electric charge stored in the EL elements 111, 112, etc. on the first line at the time of the previous light emitting operation gets around to the scanning electrode 301 side on the second line via the parasitic diode D of the P channel FET P1, the positive voltage supplying line L1 and the P channel FET P2, and though voltages applied to the scanning electrodes 201, 301, etc. fluctuate due to the ratio of light emitting pixels on the first line, they become (Vr/2), about half the scanning voltage (Vr), and electric charge roughly equivalent to the voltage (Vr/2) is stored in the EL elements on the first and second lines.

The light emitting operation in the first field on the second line will now be described.

When the P channel FET P2 within the driver IC 3 connected to the scanning electrode 301 on the second line is switched on and transfer of electric charge from the first to the second line is completed, the positive voltage supplying switch 10*a* is switched on using the voltage impressing pulse and the positive scanning voltage (Vr) is applied to the positive voltage supplying line L1 again. At this time, the timing control circuit 50 lets the data side driver IC 4 apply display voltages $V_{401}$, etc. (0V) or (VM) corresponding to the display data of a display image on the second line to the data electrodes 401, 402, 403, etc. and thereby causes the EL elements 121, etc. on the second line to emit light in accordance with the display data.

Further, when display control is finished for the EL elements 121, etc. on the second line, the timing control circuit 50 switches the P channel FET P2 off. In the present embodiment, the level of the voltage impressing pulse is made low by the operation of the floating timing control circuit 50A again after the P channel FET P2 is switched off, the positive voltage supplying circuit 10*a* is switched off and the positive voltage supplying line L1 is put in a floating state.

The discharging operation in the first field on the first line will now be described.

When the P channel FET P2 and the positive voltage supplying switch 10*a* are successively switched off after display control for the EL elements 121, etc. on the second line is finished, after a specified passage of time, the initialization timing control circuit 50B within the timing control circuit 50 switches on the N channel FET N1 within the driver IC 2 connected to the scanning electrode 301 on the first line.

As a result, the scanning electrode 201 on the first line is grounded via the N channel FET N1, the negative voltage supplying line L2 and the negative voltage side grounding switch 20*b*, and after electric charge is moved to the EL elements 121, etc. on the second line, all the electric charge equivalent to the one (Vr/2) remaining in the EL elements 111, 112, etc. are discharged.

Then, the timing control circuit 50 successively switches on the P channel FETs and the N channel FETs within the scanning side driver ICs 2 and 3, like in the order of the P channel FET P3, the N channel FET N2, the P channel FET P4, the N channel FET N3, etc., the voltage impressing pulse for which timing control is performed by the floating timing control circuit 50A is outputted to the positive voltage supplying switch 10*a* synchronously therewith, and thereby as in the case of the above the operation of moving electric charge from the scanning electrode for which display control is finished to the subsequent scanning electrode, the operation of emitting light from the EL element thereof and the operation of discharging the remaining electric charge from the scanning electrode from which electric charge is moved are successively executed.

The operation of moving and discharging electric charge in the first field on the last line will now be described.

The timing control circuit 50 executes the above-mentioned operations for every line successively until reaching the last scanning electrode SE. When display control is finished for the last scanning electrode SE, however, the timing control circuit 50 stops outputting the voltage impressing pulse to the positive voltage supplying switch 10*a* using the operation of the floating timing control circuit 50A after using voltage $V_{PE}$ to switch off the P channel FET PE connected to the last scanning electrode SE and changes the positive voltage supplying line L1 to a floating state. Then, the capacitor connecting switch 10*c* is switched on for a specified period of time.

Consequently, the last scanning electrode SE is connected to the capacitor C1 and part of the electric charge stored in the EL elements 1E1, 1E2, etc. formed by the last scanning electrode SE is stored therein.

Furthermore, if no electric charge is stored in the capacitor C1 at this time, though a great amount of electric charge flows from the last scanning electrode SE thereto in accordance with a ratio determined by the collective capacitance of the EL elements on the last scanning electrode SE side and that of the capacitor C1, since this operation is performed several times the capacitor C1 is charged up to (Vr/2). Therefore, if the device is in a stable state, the capacitor connecting switch 10*c* is switched on, and thereby a voltage applied to the last scanning electrode SE becomes roughly (Vr/2) and electric charge equivalent to (Vr/2) is left in the EL elements 1E1, 1E2, etc.

For this reason, in order to discharge all electric charge remaining in the EL elements 1E1, 1E2, etc. of the last scanning electrode SE thereafter, the timing control circuit 50 uses voltage $V_{NE}$ to switch on the N channel FET NE connected to the last scanning electrode SE for a specified period of time using the built-in initialization timing control circuit 50B and terminates display control for the first field.

Display control for the second field will now be described.

When the display control for the first field is finished, in order to move the display 1 to display control for the second field for negative voltage driving, the timing control circuit 50 first switches the negative voltage side grounding switch 20*b* from on to off and the positive voltage side grounding switch 10*b* from off to on.

In the second field, in order to make a scanning voltage applied to each scanning electrode negative (−Vr+VM), the voltage impressing pulse for which timing control is performed by the floating timing control circuit 50A is outputted to the negative voltage supplying switch 20*a,* the N channel FETs N1, N2, etc. within the scanning side driver ICs 2 and 3 are used to apply a scanning voltage to each scanning electrode, the P channel FETs P1, P2, etc. are used to discharge electric charge from each scanning electrode side and further, by moving electric charge stored in the EL elements 1E1, 1E2, etc. on the last scanning electrode SE ($V_{SE}$ representing the voltage on the scanning electrode SE) side to the capacitor C2 the capacitor connecting switch 20*c* is switched on before a scanning voltage is applied to the scanning electrode 201 on the first line and when display control for the last scanning electrode SE is finished.

Consequently, in the second field, the voltages of the capacitor C2 converge on ((−Vr+VM)/2), roughly half the scanning voltage, by the movement of electric charge from the last scanning electrode SE side thereto, electric charge equivalent to this voltage is stored therein, and at the time of starting display control for the second field electric charge equivalent to a voltage ((−Vr+VM)/2) is charged to the EL elements 111, 112, etc. on the first line prior to application of the scanning voltage (−Vr+VM).

In the second field, for negative voltage driving, control timings for switching the switches and the FETs on and off are the same as in the case of the first field, and thus explanation thereof will be omitted.

As described above, in the second embodiment, the positive voltage supplying line L1 or the negative voltage supplying line L2 is put in a floating state using the floating timing control circuit 50A after scanning voltages are applied to the scanning electrodes 201, 301, etc. and display control is performed for the corresponding EL elements 111, 112, 121, etc., the scanning electrode and the one for which display control is subsequently performed are directly connected, and thereby part of the electric charge (roughly half) is moved from the EL element for which display control is finished to the one on the scanning electrode side for which display control is performed next. In this way, as in the case of the above-mentioned embodiment, the electric power consumed in driving the display 1 can be reduced.

Also, in the second embodiment, when electric charge is moved from the scanning electrode side for which display control is finished to that for which display control is performed next, the former is grounded and the remaining electric charge is discharged by the operation of the refreshing timing control circuit 50B, and thus compared with the first embodiment the period of time for the remaining of electric charge in the EL element can be shortened and the durability thereof can be improved.

Moreover, since electric discharging from the EL element is performed for every frame in the above-mentioned embodiment, the periods of time for electric charges remaining in the EL elements are different among the scanning electrodes and quality decline is easier in the EL elements on the side for which display control is performed earlier. On the other hand, in the present embodiment, since the electric charge remaining time in the EL elements is roughly the same on all the lines, there is less variance in quality decline and the display 1 can be stably used for a long time.

Further, in the present embodiment, since electric charge stored in the EL elements 1E1, 1E2, etc. formed by the last scanning electrode SE is temporarily stored in the capacitor C1 or C2 and then, when the display 1 is driven by the same polarity, the EL elements 111, 112, etc. on the first line are charged by electric charge stored in the capacitor C1 or C2 prior to application of a scanning voltage to the scanning electrode 201 thereon, the electric power consumed for display control for the EL elements 111, 112, etc. on the first line can be limited and thus power consumed for driving the display 1 can be further reduced.

In the above explanation, reference was made to convergence of voltages of the capacitors C1 and C2 to roughly half the scanning voltage, that is, (Vr/2) and ((−Vr+VM)/2) while transfer of electric charge from the last scanning electrode SE to the capacitors C1 and C2 is performed repeatedly. However, the capacitors C1 and C2 may be charged up to (Vr/2) and ((−Vr+VM)/2) in the initial period of driving the device.

Furthermore, though the timing control circuit 50 is used in the above-mentioned embodiment, an FPGA (field programmable gate array) or the like may be used instead, thereby realizing simpler operations. That is, circuits equivalent to the floating timing control circuit 50A and the initialization timing control circuit 50B may be provided in the FPGA and the driver ICs 2, 3 and 4 may be controlled with timing similar to the circuits 50A and 50B.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A driver for an EL display, said EL display having an EL layer, a plurality of scanning electrodes on one side of said EL layer in parallel, at least one data electrode on an opposite side of said EL layer in a direction orthogonally crossing said scanning electrodes and EL elements constituting pixels formed at intersections of said at least one data electrode and said scanning electrodes, for displaying an image on said EL display by applying driving voltages to said at least one data electrode and said scanning electrodes, said driver comprising:

scanning voltage impressing means for successively applying scanning voltages to said plurality of scanning electrodes at a prescribed scanning timing, the scanning voltage impressing means including push-pull switching drivers connected between a first voltage supplying line and a second voltage supplying line, each of said push-pull switching drivers having a first switching circuit having a parasitic diode and a second switching circuit having a parasitic diode connected to said first switching circuit in series, said scanning voltages being provided from a connecting point between said first switching circuit and said second switching circuit;

display voltage impressing means for successively applying display voltages corresponding to display data to said at least one data electrode synchronously with said scanning timing;

scanning voltage reversing means for reversing a polarity of said scanning voltages every field for which said scanning voltage impressing means completes application of said scanning voltages to all of said scanning electrodes by changing a polarity of voltages applied to said first voltage supplying line and said second voltage supplying line;

electric charge moving means, in said scanning voltage impressing means, for connecting a first scanning electrode to which a scanning voltage has been applied to a next scanning electrode to which a scanning voltage is to be applied next by turning off one of said first switching circuit and said second switching circuit of said push-pull switching drivers connected to said first scanning electrode, and by turning on one of said first switching circuit and said second switching circuit of said push-pull switching drivers connected to said next scanning electrode, finishing applying said scanning voltage to said first scanning electrode before applying said scanning voltage to said next scanning electrode, and moving part of an electric charge stored in an EL element formed by said first scanning electrode to an EL element formed by said next scanning electrode via said parasitic diode of said one of said first switching circuit and said second switching circuit of said push-pull switching drivers connected to said first scanning electrode and via said one of said first switching circuit and said second switching circuit of said push-pull switching drivers connected to said next scanning electrode.

2. A driving device for an EL display according to claim 1, said scanning voltage impressing means comprising:

a common path for supplying said scanning voltages to said scanning electrodes;

driving means for successively turning on said push-pull drivers synchronously at said scanning timing; and voltage supplying means for cyclically applying said scanning voltages to said common path synchronously at said scanning timing;

wherein said electric charge moving means is for connecting the first scanning electrode to which a scanning voltage has been applied to the next scanning electrode to which a scanning voltage is subsequently applied via said common path by selectively turning on said switching elements at a floating timing when said voltage supplying means applies no scanning voltage to said common path.

3. A driving device for an EL display according to claim 2, said electric charge moving means comprising:

an electric charge storing capacitor having a capacitance greater than a capacitance of at least one EL element formed by said scanning electrodes; and a capacitor connecting switch selectively connecting said capacitor to said common path;

wherein when application of a scanning voltage to a last scanning electrode, among said plurality of scanning electrodes, to which said scanning voltage is applied last is finished, said capacitor connecting switch is turned on for a specified period of time and part of an electric charge stored in an EL element formed by said last scanning electrode is moved to said capacitor; and when a scanning voltage is applied to a scanning electrode, among said plurality of scanning electrodes, in an initial stage to which said scanning voltage is applied first, said capacitor connecting switch is turned on for a specified period of time and part of said electric charge stored in said capacitor is moved to said EL element formed by said scanning electrode in said initial stage.

4. A driving device for an EL display according to claim 3, further comprising:

discharging means for discharging electric charge remaining in said EL element formed by said first scanning electrode from which electric charge has been moved after application of a scanning voltage;

wherein movement of electric charge is performed by said scanning voltage impressing means and said electric charge moving means with respect to at least one scanning electrode.

5. A driving device for an EL display according to claim 2, further comprising:

discharging means for discharging electric charge remaining in said EL element formed by said first scanning electrode from which electric charge has been moved after application of a scanning voltage;

wherein movement of electric charge is performed by said scanning voltage impressing means and said electric charge moving means with respect to at least one scanning electrode.

6. A driving device for an EL display according to claim 1, further comprising:

discharging means for discharging electric charge remaining in said EL element formed by said first scanning electrode from which electric charge has been moved after application of a scanning voltage;

wherein movement of electric charge is performed by said scanning voltage impressing means and said electric charge moving means with respect to at least one scanning electrode.

7. A driver for an EL display, said EL display having an EL layer, a plurality of scanning electrodes on one side of said EL layer in parallel, at least one data electrode on an opposite side of said EL layer in a direction orthogonally crossing said scanning electrodes and EL elements constituting pixels formed at intersections of said at least one data electrode and said scanning electrodes, for displaying an image on said EL display by applying driving voltages to said at least one data electrode and said scanning electrodes, said driver comprising;

scanning voltage impressing means for successively applying scanning voltages to said plurality of scanning electrodes at a prescribed scanning timing, the scanning voltage impressing means including push-pull switching drivers connected between a first voltage supplying line and a second voltage supplying line, each of said push-pull switching drivers having a first switching circuit having a parasitic diode and a second switching circuit having a parasitic diode connected to said first switching circuit in series, said scanning voltages being provided from a connecting point between said first switching circuit and said second switching circuit;

display voltage impressing means for applying display voltages corresponding to display data to said at least one data electrode synchronously at said scanning timing;

refreshing voltage impressing means for applying a refreshing voltage having a polarity different from a polarity when an image is displayed on all of said scanning electrodes and said at least one data electrode for each field and for preventing polarization of said EL layer; and electric charge moving means, in said scanning voltage impressing means, for connecting a first scanning electrode to which a scanning voltage has been applied to a next scanning electrode to which a scanning voltage is to be applied next by turning off one of said first switching circuit and said second switching circuit of said push-pull switching drivers connected to said first scanning electrode, and by turning on one of said first switching circuit and said second switching circuit of said push-pull switching drivers connected to said next scanning electrode, finishing applying said scanning voltage to said first scanning electrode before applying said scanning voltage to said next scanning electrode, and moving part of an electric charge stored in an EL element formed by said first scanning electrode to an EL element formed by said next scanning electrode via said parasitic diode of said one of said first switching circuit and said second switching circuit of said push-pull switching drivers connected to said first scanning electrode and via said one of said first switching circuit and said second switching circuit of said push-pull switching drivers connected to said next scanning electrode.

8. A driving device for an EL display according to claim 7, said scanning voltage impressing means comprising:

a common path for supplying said scanning voltages to said scanning electrodes;

driving means for successively turning on said plurality of push-pull switching drivers synchronously at said scanning timing; and voltage supplying means for cyclically applying said scanning voltages to said common path synchronously at said scanning timing;

wherein said electric charge moving means is for connecting said first scanning electrode to which a scanning voltage has been applied to said next scanning electrode to which a scanning voltage is subsequently to be applied via said common path by selectively turning on said push-pull switching drivers at a floating timing when said voltage supplying means applies no scanning voltage to said common path.

9. A driving device for an EL display according to claim 8, said electric charge moving means comprising:

an electric charge storing capacitor having a capacitance greater than a capacitance of at least one EL element formed by said scanning electrodes; and a capacitor connecting switch selectively connecting said capacitor to said common path;

wherein when application of a scanning voltage to a last scanning electrode, among said plurality of scanning electrodes, to which said scanning voltage is applied last is finished, said capacitor connecting switch is turned on for a specified period of time and part of an electric charge stored in an EL element formed by said last scanning electrode is moved to said capacitor; and when a scanning voltage is applied to a scanning electrode, among said plurality of scanning electrodes, in an initial stage to which said scanning voltage is applied first, said capacitor connecting switch is turned on for a specified period of time and part of said electric charge stored in said capacitor is moved to said EL element formed by said scanning electrode in said initial stage.

10. A driving device for an EL display according to claim 9, further comprising:

discharging means for discharging electric charge remaining in said EL element formed by said first scanning electrode from which electric charge has been moved after application of a scanning voltage;

wherein movement of electric charge is performed by said scanning voltage impressing means and said electric charge moving means with respect to at least one scanning electrode.

11. A driving device for an EL display according to claim 8, further comprising:

discharging means for discharging electric charge remaining in said EL element formed by said first scanning electrode from which electric charge has been moved after application of a scanning voltage;

wherein movement of electric charge is performed by said scanning voltage impressing means and said electric charge moving means with respect to at least one scanning electrode.

12. A driving device for an EL display according to claim 7, further comprising:

discharging means for discharging electric charge remaining in said EL element formed by said first scanning electrode from which electric charge has been moved after application of a scanning voltage;

wherein movement of electric charge is performed by said scanning voltage impressing means and said electric charge moving means with respect to at least one scanning electrode.

13. An EL display system including an EL display unit and a driver for said EL display unit, said EL display unit having a plurality of scanning electrodes on one side of an EL layer in parallel, at least one data electrode being on an opposite side of said EL layer in a direction orthogonally crossing said scanning electrodes, and a plurality of EL elements at intersections between said scanning electrodes and said at least one data electrode of said EL layer for emitting light responsive to scanning voltages and display voltages applied to said scanning electrodes and said at least one data electrode, said EL display unit comprising:

scanning voltage impressing means connected to said plurality of scanning electrodes for successively applying said scanning voltages to said scanning electrodes at a prescribed scanning timing, said scanning voltage impressing means including a common line path, connected to each of said plurality of scanning electrodes, supplying said scanning voltages to said scanning electrodes, voltage supplying means, connected to said common line path, for applying said scanning voltages to said common line path synchronously at said scanning timing, a plurality of push-pull switching drivers between said common line path and said scanning electrodes, each of said push-pull switching drivers being connected between a first voltage supplying line and a second voltage supplying line and having a first switching circuit having a parasitic diode and a second switching circuit having a parasitic diode connected to said first switching circuit in series, said scanning voltages being provided from a connecting point between said first switching circuit and said second switching circuit, and driving means for successively turning on said plurality of push-pull switching drivers synchronously at said scanning timing, and for applying said scanning voltages to said scanning electrodes;

display voltage impressing means, connected to said at least one data electrode, for applying said display voltages to said at least one data electrode synchronously at said scanning timing; and said driver comprising:

a timing control circuit connected to said voltage supplying means and said driving means so that at a floating timing of said voltage supplying means, a switching push-pull switching driver connected to a first scanning electrode to which a scanning voltage has been applied and a push-pull switching driver connected to a next scanning electrode to which a scanning voltage is to be subsequently supplied are simultaneously turned on and said first scanning electrode and said next scanning electrode are connected via said common line path and part of an electric charge stored in an EL element corresponding to said first scanning electrode is transferred to an EL element corresponding to said next scanning electrode via said parasitic diode of said one of said first and second switching circuits of said push-pull switching driver connected to said first scanning electrode and via said one of said first and second switching circuits of said push-pull driver connected to said next scanning electrode.

14. An EL display driver having a plurality of scanning electrodes on one side of an EL layer in parallel, at least one data electrode on an opposite side of said EL layer in a direction orthogonally crossing said scanning electrodes, and a plurality of EL elements at intersections between said scanning electrodes and said at least one data electrode of said EL layer emitting light responsive to scanning voltages and display voltages applied thereto, said driver comprising:

scanning electrode impressing means connected to said plurality of scanning electrodes for successively applying said scanning voltages to said scanning electrodes at a prescribed scanning timing, said scanning electrode impressing means including a common line path, connected to each of said plurality of scanning electrodes, supplying said scanning voltages to each of said scanning electrodes, voltage supplying means, connected to said common line path, for applying said scanning voltages thereto synchronously at said scanning timing, a plurality of push-pull switching drivers between said common line path and each of said scanning electrodes, each of said push-pull switching drivers being connected between a first voltage supplying line and a second voltage supplying line and having a first switching circuit having a parasitic diode and a second switching circuit having a parasitic diode connected to said first switching circuit in series, said scanning voltages being provided from a connecting point between said first switching circuit and said second switching circuit, and driving means for successively turning on said push-pull switching drivers synchronously at said scanning timing, and for applying said scanning voltages to said scanning electrodes;

display voltage impressing means, connected to said at least one data electrode, for applying said display voltages to said at least one data electrode synchronously at said scanning timing; and a timing control circuit connected to said voltage supplying means and said driving means for controlling said voltage supplying means and said driving means by simultaneously turning on a push-pull switching driver connected to a first scanning electrode to which a scanning voltage has been applied and a push-pull switching driver connected to a next scanning electrode to which a scanning voltage is applied next at a floating timing of said voltage supplying means, said first scanning electrode and said next scanning electrode being connected via said common line path, and part of an electric charge stored in said EL element connected to said first scanning electrode is moved to said EL element connected to said second scanning electrode via said parasitic diode of said one of said first and second switching circuits of said push-pull switching driver connected to said first scanning electrode and via said one of said first and second switching circuits of said push-pull driver connected to said next scanning electrode.

* * * * *